United States Patent [19]

Kornerup et al.

[11] Patent Number: 5,070,649

[45] Date of Patent: Dec. 10, 1991

[54] WINDOW, ESPECIALLY FOR INSTALLATION IN AN INCLINED ROOF

[75] Inventors: Klaus Kornerup, Birkerod; Lena Nygaard, Frederikssund, both of Denmark

[73] Assignee: V. Kann Rasmussen Industri A/S, Soborg, Denmark

[21] Appl. No.: 573,319

[22] PCT Filed: Apr. 5, 1989

[86] PCT No.: PCT/DK89/00073

§ 371 Date: Oct. 1, 1990

§ 102(e) Date: Oct. 1, 1990

[87] PCT Pub. No.: WO89/10460

PCT Pub. Date: Nov. 2, 1989

[30] Foreign Application Priority Data

Apr. 8, 1988 [DK] Denmark ..... 1917/88

[51] Int. Cl.[5] ..... E05F 1/10

[52] U.S. Cl. ..... 49/386; 49/390; 52/72

[58] Field of Search ..... 49/386, 380, 379, 390; 52/72

[56] References Cited

U.S. PATENT DOCUMENTS 4,416,094 11/1983 Bügener et al. ..... 49/386 X 4,429,494 2/1984 Kornerup et al. ..... 49/386

4,611,432 9/1986 Lund et al. ..... 49/390 X 4,785,499 11/1988 Giuffrida et al. ..... 49/386 X 4,845,905 7/1989 Frank ..... 49/386 X

*Primary Examiner*—Philip C. Kannan

*Attorney, Agent, or Firm*—Lane, Aitken & McCann

[57] ABSTRACT

A window, particularly designed to be installed in an inclined roof, comprises a top-hinged sash which via a lifting arm is connected with a slide shoe displaceable along a guidance of a lateral frame member. An intermediate member is provided with a transverse pin adapted to be connected with a pocket in the top side of the slide shoe, and the intermediate member is loaded or biased in a direction towards the lower end of the guidance by means of a spring. A spacer serves to hold the intermediate member ready for engagement. When the window has been installed in the roof, the appropriate pocket to be engaged by the transverse pin is selected with due regard to the roof inclination, i.e. the pocket resulting in a desired opening force acting on the sash, which is then swung open until the transverse pin engages the selected pocket, whereupon the sash is swung slightly in its closing direction to release the spacer for removal. The spring may be inserted in the window in prestressed condition by the manufacturer and yet be prevented from exerting any opening force on the sash during handling or installation of the window.

3 Claims, 1 Drawing Sheet

FIG. 2

WINDOW, ESPECIALLY FOR INSTALLATION IN AN INCLINED ROOF

Figure 1:
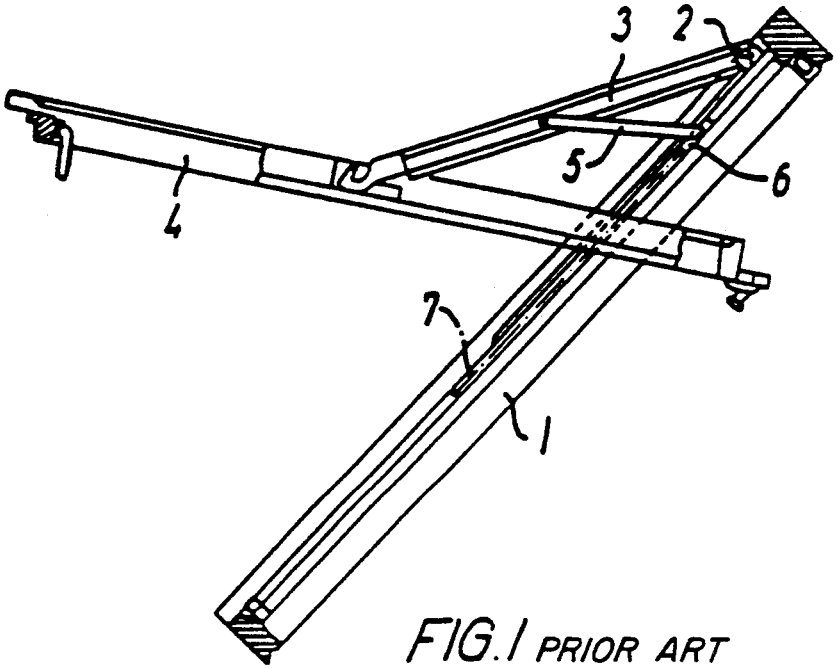
FIG. 1 PRIOR ART

This invention relates to a window, particularly designed to be installed in an inclined roof, comprising a frame, a sash hinged to the main frame at the top thereof, and a sash lifting arm inserted between the frame and the sash and having one end pivotally connected with a lateral frame or sash member and its other end pivotally connected with a slide shoe that is displaceable along a corresponding lateral member of the sash or the frame, respectively, and is associated with a pre-stressed spring.

Such a window, inter alia disclosed in DK patent No. 146,808 in which the top-hinged frame is either glass-carrying in itself or serves to support a glass-carrying pivotal sash, as also known from DK patent No. 148,425, may be offered by the manufacturer with mounted and pre-stressed spring, and in connection with the installation of the window the pre-stressing has to be finely adjusted in dependence on the actual roof inclination. The bias force depends on the weight of the window sash and may be in the range between 0.5 and 5 kN, i.e. forces of a magnitude which a person is incapable of handling straight away.

According to the invention a window of the above mentioned type is characterized in that the slide shoe and the pre-stressed spring are provided with coupling means adapted to be brought into engagement with each other in conjunction with the installation of the window.

It is thus possible in factory to insert and pre-stress the spring without simultaneously connecting the spring with the slide shoe, so that the window can be handled, transported and installed without any risk that the window due to unintentional release of the sash from the main frame suddenly jumps into its open position by the actuation of the spring. Only when the window has been installed in the roof opening with the sash facing upwards and loaded in the downwards direction by the force of gravity, the sash will be biassed to open when the coupling means of the slide shoe and the pre-stressed spring are brought into mutual engagement.

In respect of finely adjusting the spring bias force in a simple manner in dependence on the roof inclination the slide shoe of the window according to the invention is preferably provided with a plurality of coupling means positioned consecutively in the longitudinal direction of the lateral member.

The displacement of the slide shoe and thus the opening movement of the window may be restricted by a stop and in that case the window according to the invention is preferably designed in such a manner that the coupling means associated with the spring is supported by an intermediate member, and that a detachable spacer adapted to hold the intermediate member ready for engagement is located between the intermediate member and a stop for the slide shoe. The spacer is inserted between the stop and the intermediate member in connection with the mounting of the spring in factory and is only removed after the spring and the slide shoe have been assembled.

In a particularly simple and handy embodiment of the invention by which the connection, after the window has been installed in the roof, is effected merely by opening the window until the coupling means engage, the intermediate member is U-shaped and comprises a coupling means formed by a transverse pin extending between the U-branches and adapted to engage pockets in the upper side of the slide shoe, the intermediate member at its bottom being pivotally connected with a pull rod for transferring the spring force.

Figure 2:
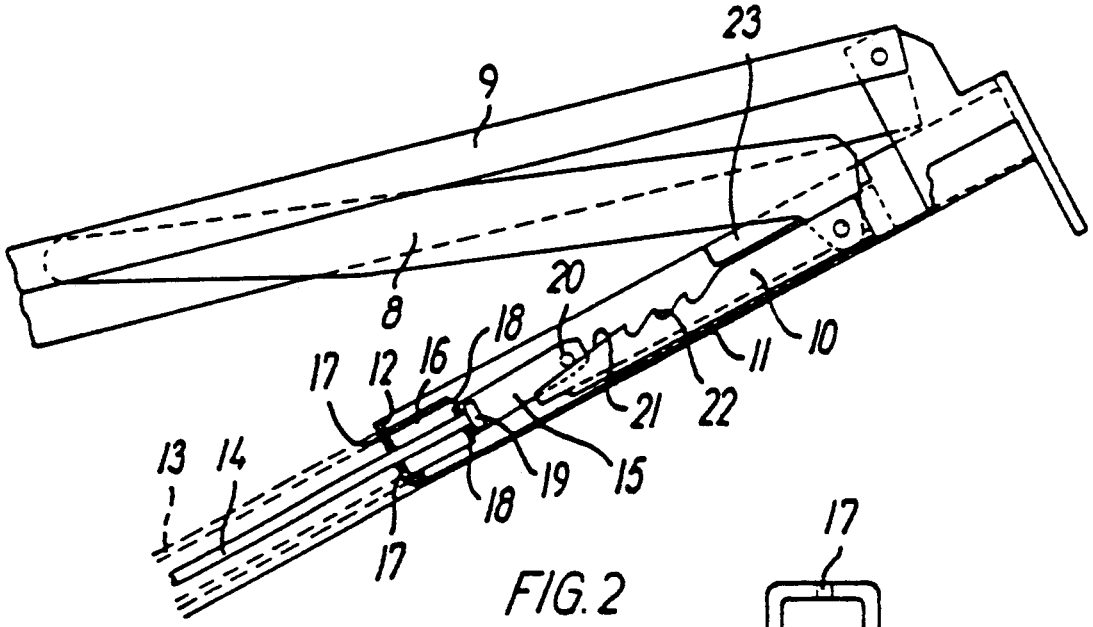

The invention will now be explained in detail with reference to the drawings, in which FIG. 1 illustrates a known window in a schematical side elevation and partially in section, the window being in its opened position and the glass-carrying sash released from the intermediate frame, FIG. 2 is a schematical side elevation of section of an embodiment of a window according to the invention, and FIG. 3 an end view on a larger scale of a spacer of the window in FIG. 2.

The main frame 1 shown in FIG. 1 is at its top connected through a hinge 2 with an intermediate frame 3 forming the support of a glass-carrying sash 4 and urged to open by lifting levers 5 pivotally connected with slide shoes 6 displaceable in the longitudinal direction of the frame lateral member. The slide shoe is biassed in the downwards direction along the lateral member by means of a spring only illustrated in dotted line 7 and which may be a tension spring firmly connected with the slide shoe.

In order to prevent damages to the window and/or injuries to persons while handling the window prior to installation, the slide shoe and the spring may instead, according to the invention, be designed as illustrated in FIG. 2, in which a lifting arm 8 at one end is pivotally connected with a glass-carrying and top-hinged sash 9 and at its other end is pivotally connected with a U-shaped slide shoe 10 displaceable along a guidance 11 in the lateral frame member. A stop 12 at the lower end forms a seat for a helical pressure spring 13 which via a pull rod 14 urges an intermediate member 15 towards the stop. The window is shown ready for shipment and with the sash non-biassed to open, because the intermediate member 15 has not yet been brought into engagement with the slide shoe. A spacer 16 is inserted between the intermediate member and the stop 12.

In order to facilitate manufacturing, the stop 12 may be a separate plate to be secured on the guidance 11, and the stop 12, spring 13, rod 14, intermediate member 15 and spacer 16 may be assembled into a unit to be inserted in the frame member, which is in particular advantageous in case of strong pre-stressing forces.

Figure 3:
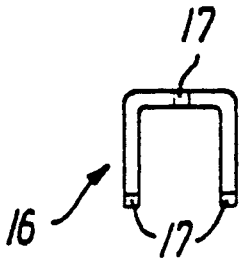

FIG. 3 is a view of the end of the spacer 16 facing the stop. As seen, the spacer is U-shaped and provided with three lugs 17 for engagement with the stop. Four lugs 18 act as guides for the intermediate member 15, thereby holding it in a position ready for engagement.

The U-shaped intermediate member 15 is positioned with a branch on either side of the slide shoe 10. The pull rod 14 extends loosely through a hole at the bottom of the intermediate member and includes a head 19 abutting thereon. The underside of the head 19 is convex and may for instance be constituted by a section of a cylinder surface, thereby allowing the intermediate member a certain oscillation about the head without tilting on an edge. Between the branches the intermediate member has a transverse pin 20 which in the illustrated position rests on a ramp surface 21 on the top side of the slide shoe. It will appear that the ramp surface merges into consecutive pockets 22 in the upper side of the slide shoe and that a guide 23 retains the slide shoe against the bottom of the guidance 11.

After the window has been installed in the roof, the appropriate pocket 22 to be engaged by the transverse pin 20 is selected with due regard to the roof inclination, viz. the pocket that will give a suitable pre-stressing of the spring to bias the lifting arm 8, and the connection is established in a simple manner by opening the window, thereby causing a displacement of the slide shoe in the direction towards the stop 12, until the pin 20 drops down into the specific pocket. The window is then closed so that the intermediate member due to the pin and pocket engagement is pulled clear of the spacer which is then removed.

In order to ensure the connection the pockets 22 are formed with such a confined depth that the centre of the transverse pin 20 engaging the pocket is located above the longitudinal axis of the pull rod, thereby tightening the transverse pin against the pocket bottom.

Embodiments of the window different from the one illustrated are obviously feasible. Thus, the spring 13 and pull rod 14 may be replaced by a tension spring, the spring assembly and the slide shoe may be inserted in the sash member or the coupling means may be formed directly on the pull rod and on the lower end of the slide shoe, thereby making the intermediate member and the spacer superfluous.

We claim:

1. A window, particularly designed to be installed in an inclined roof, comprising a frame (1), a sash (4; 9) hinged to the frame at the top thereof, and a sash lifting arm (5; 8) inserted between the frame and the sash and having one end pivotally connected with a lateral frame or sash member and its other and pivotally connected with a slide shoe (6; 10) that is displaceable along a corresponding lateral member of the sash or the frame, respectively, and is associated with a pre-stressed spring (7; 13) characterized in that the slide shoe (10) is provided with a plurality of coupling means (22) positioned consecutively in the longitudinal direction of the lateral member, and that the pre-stressed spring (13) is provided with coupling means (20) adapted to be brought into engagement with one of the coupling means (22) of the slide shoe in conjunction with the installation of the window.

2. A window as claimed in claim 1, characterized in that the coupling means associated with the spring is supported by an intermediate member (15), and that a detachable spacer (16) adapted to hold the intermediate member ready for engagement is located between the intermediate member and a stop (12) for the slide shoe.

3. A window as claimed in claim 2, characterized in that the intermediate member (15) is U-shaped and comprises a coupling means formed by a transverse pin (20) extending between the U-branches and adapted to engage pockets (22) in the upper side of the slide shoe, the intermediate member at its bottom being pivotally connected with a pull rod (14) for transferring the spring force.

* * * * *